US005535178A

United States Patent [19]

Hayenga

[11] Patent Number: 5,535,178

[45] Date of Patent: Jul. 9, 1996

[54] ADJUSTABLE SUSPENSION FORK

[76] Inventor: Lubertus H. Hayenga, 1135 Morton St., Alameda, Calif. 94501

[21] Appl. No.: 352,387

[22] Filed: Dec. 8, 1994

[51] Int. Cl.[6] ..... G04B 17/02

[52] U.S. Cl. ..... 368/180

[58] Field of Search ..... 368/179, 165, 368/166

[56] References Cited

U.S. PATENT DOCUMENTS

| | | | |
|---|---|---|---|
| 768,913 | 8/1904 | Sims | 368/179 |
| 2,625,787 | 1/1953 | Reiner | 368/179 |
| 4,020,624 | 5/1977 | Steinle et al. | 368/179 |
| 4,544,282 | 10/1985 | Giradez | 368/179 |

OTHER PUBLICATIONS

Terwilliger, C. *400–Day Clock Repair Guide,* The Horolovar Company, St. Clair Shores, Missouri (1991) (41 pages).

*Primary Examiner*—Bernard Roskoski
*Attorney, Agent, or Firm*—Klarquist Sparkman Campbell Leigh & Whinston

[57] ABSTRACT

A suspension fork for a 400-day anniversary clock is disclosed. The suspension fork includes a main fork and a tuning fork interconnected by an adjustment mechanism to permit easy and precise adjustment of the beat of the clock. The main fork includes a proximal end that is connected to a suspension spring which supports a torsion pendulum. The main fork further includes arms which are connected together at the proximal end and are spread apart at a distal end. The adjustment mechanism connects to the main fork at its distal end. A tuning fork is connected to the adjustment mechanism and is arranged so that its tines surround and interact with an anchor pin associated with the escapement of the clock. Operation of the adjustment mechanism causes the tuning fork to move relative to the main fork for precise adjustment of the beat.

19 Claims, 3 Drawing Sheets

ADJUSTABLE SUSPENSION FORK

BACKGROUND OF THE INVENTION

1. Field of the Invention

This invention pertains to the field of mechanical clocks and, more particularly, to torsion pendulum clocks generally referred to as 400-day clocks, or anniversary clocks.

2. Description of the Related Art

Various designs and repair procedures for 400-day clocks are described in detail in a book entitled 400-Day Clock: Repair Guide by Charles Terwilliger (copyright 1991 by The Horolovar Company, Library of Congress Catalogue Card No. 83-81592). Although commonly called 400-day clocks, or anniversary clocks, they are mechanically categorized as torsion pendulum clocks.

Torsion pendulum clocks use a mainspring as the power source. Timing is maintained by the pendulum. The mainspring provides power to a ratchet mechanism for urging an escapement wheel into rotational motion. The ratchet mechanism includes an anchor that oscillates or "rocks" about a midpoint. The anchor includes distal pallets that engage teeth on the escapement wheel. As the anchor rocks back and forth, alternate pallets engage teeth of the escapement wheel. Thus, as the anchor goes through its rocking motion, one of the pallets disengages an escapement wheel tooth while the opposite pallet engages a tooth. During a single rocking motion of the anchor, the escapement wheel will advance a rotational distance equal to one-half tooth.

Additionally, the mainspring maintains torque on the escapement wheel. The wheel, in turn, urges the anchor into its rocking motion through minute impulses on the pallets. The anchor's rocking motion is communicated to an anchor pin which is mounted atop the anchor. A suspension fork, having tines on either side of the anchor pin, is fixedly connected to a suspension spring which suspends the torsion pendulum. Thus, the energy from the mainspring is converted into discrete impulses that cause an alternating rotation of the suspension spring which in turn oscillates the pendulum.

One of the most difficult adjustments associated with torsion pendulum clocks is setting the "beat." A clock is in beat when the impulses provided from the mainspring through the ratchet mechanism to the suspension fork are synchronized to occur symmetrically about a neutral position. (The neutral position is defined as the position the pendulum and suspension spring would assume when in static equilibrium, i.e., hanging without motion.) The tiny impulses from the ratchet mechanism to the fork (and thus the suspension spring) must occur at the exact same distance from the neutral position in order to maintain oscillation of the pendulum. Clocks which are even minutely out of beat will eventually stop running.

In all prior art clocks, beat was adjusted by turning the entire suspension system comprising the pendulum, suspension spring, and the suspension fork to align the fork relative to the anchor pin. Two principal methods were used to turn the suspension system. In a few older clocks, the suspension spring suspended from a fixed saddle, and it was thus necessary to adjust the suspension spring by twisting it until it deformed.

All 20th century clocks provide an adjustable saddle which includes a friction fit or a set screw that can be loosened. The adjustable saddles permit rotation of the suspension spring, fork, and pendulum. Although superior to the previous method, such adjustment is a delicate operation requiring very precise and skillful work.

A beat setting tool, disclosed in U.S. Pat. No. 196,385, provides a lever advantage for turning the saddle. Although helpful, this tool does not substantially assist with the precision required for setting the clock's beat. What is needed then is an easy and reliable apparatus for precise and accurate adjustment of the beat in torsion pendulum clocks.

SUMMARY OF THE INVENTION

The present invention solves the above-noted problems by providing an adjustable suspension fork which permits easy and accurate adjustment of the beat. In its preferred embodiment, the suspension fork of the present invention comprises two forks that are adjustably interconnected. The first fork, a main fork, includes distal spread-apart arms. An adjustment mechanism, preferably a threaded rod, is rotatably mounted to the main fork at its distal end. A second, smaller fork, referred to herein as a tuning fork, is mounted to the adjustment mechanism and includes a distal end which interacts with the anchor pin of the ratchet mechanism. With the present invention, the clock's beat may be adjusted by turning the adjustment mechanism so that the tuning fork moves relative to the main fork. Thus, with the present invention, it is not necessary to rotate any part of the suspension system in order to adjust the final beat.

Alternative embodiments include main forks having various configurations including a wishbone shape, a box-like shape, and an arm having a siamese end. Other embodiments include adjustment mechanisms other than threaded rods and also tuning forks that are directly coupled to the anchor pin.

Various advantages and features of novelty which characterize the invention are particularized in the claims forming a part hereof. However, for a better understanding of the invention and its advantages, reference should be had to the drawings and to the accompanying description in which there is illustrated and described preferred embodiments of the invention.

DETAILED DESCRIPTION OF THE PREFERRED EMBODIMENTS

An understanding of the prior art system is essential to an understanding of the present invention. Accordingly, with reference to FIG. 1, the prior art clockwork with suspension fork will be explained.

Figure 1:
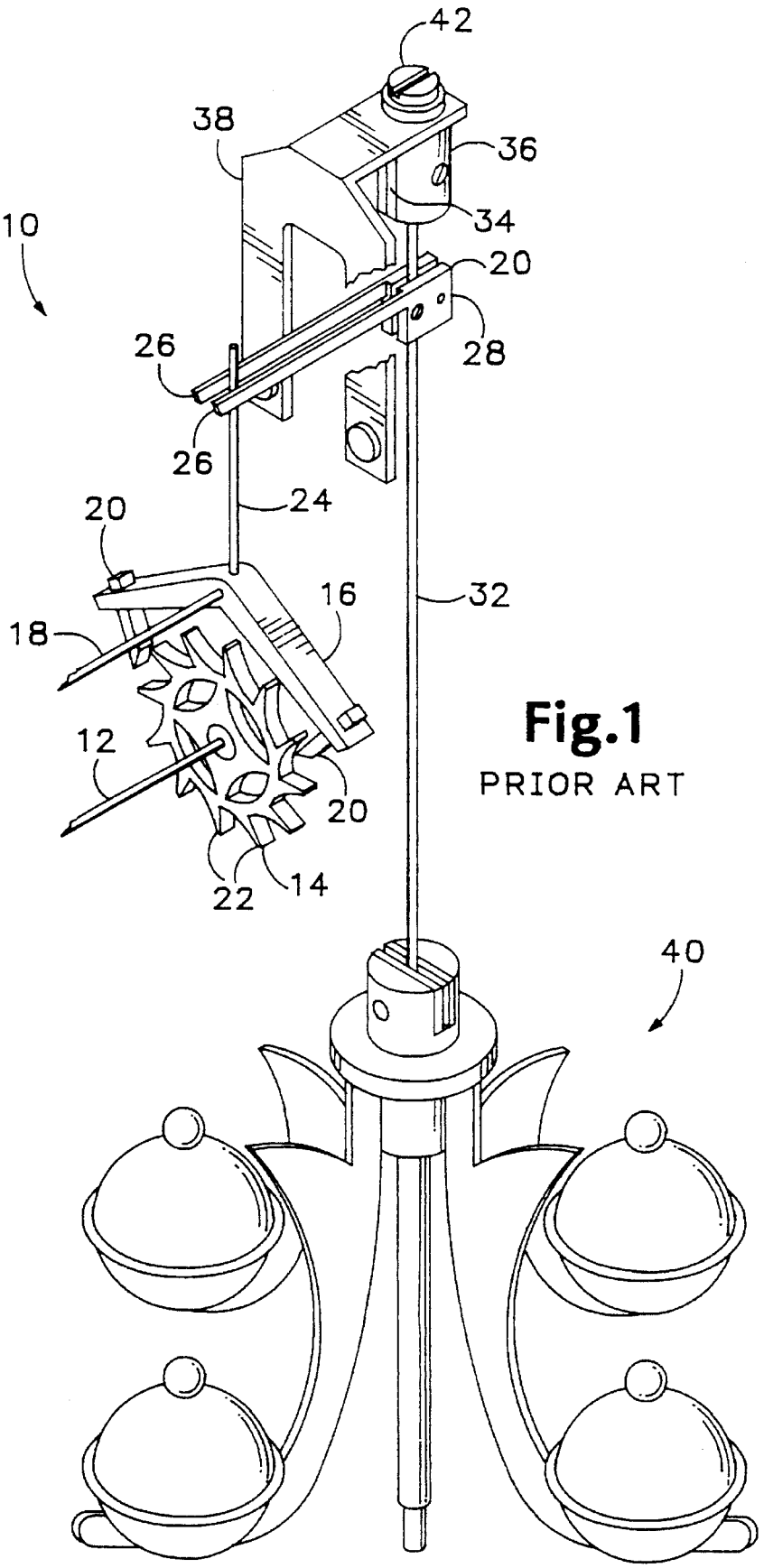
Fig.1 PRIOR ART
FIG. 1 is a perspective view of a portion of a torsion pendulum clockwork including a prior art suspension fork.

A complete clockwork includes a mainspring, a plurality of shafts and gears for power transmission, a clock face, and frame or support structure for the clockworks. Although common to most torsion pendulum spring clocks, these elements are available in many different embodiments. In FIG. 1 there is shown a portion of a clockwork 10 with sufficient mechanisms to show the environment in which the present invention will be applied.

As noted, the mainspring (not shown) provides power for the clock. Power is transmitted from the mainspring through a series of shafts and gears (also not shown); a portion of the power ends up at shaft 12 for urging the shaft in a rotational direction. Shaft 12 is connected to an escapement wheel 14, which is similarly urged in a rotational direction by the mainspring power. An anchor 16 is arranged to interact with the escapement wheel 14 and is mounted so as to pivot about a pivot rod 18 located at an approximate midpoint of the anchor 16. At distal ends of the anchor 16, pallets 20 are attached. The pallets engage teeth 22 of the escapement wheel 14. The pallets 20 and anchor 16 are arranged so that when one pallet 20 is engaged with the teeth 22, the alternate pallet is disengaged from the teeth 22. When the anchor 16 pivots about rod 18 each pallet becomes alternately engaged and disengaged, asynchronously.

The anchor 16 also includes an anchor pin 24 that is attached to the proximal midpoint of the anchor 16. As arranged, and as shown in FIG. 1, the anchor pin 24 moves with the anchor 16 such that the motion of the pin resembles an inverted pendulum of a metronome. Put another way, the pin 24 moves back and forth about the axis of the rod 18.

As the anchor pin 24 oscillates back and forth, it pushes against tines 26 of a suspension fork 28. The proximal end 30 of the suspension fork 28 is fixedly connected to a suspension spring 32. Thus, as the anchor pin oscillates and pushes against the tines 26, the force is communicated to the suspension spring 32 causing it to oscillate torsionally. A torsion pendulum 40 is attached to the lower end of the spring 32 and rotates back and forth as a result of the torsion in the pins. The pendulum 40 is depicted as having four balls 41. There are hundreds of alternative embodiments of torsion pendulums ranging from flat discs to intricate figurines.

The suspension spring 32 is connected at its top end to a top block 34 which is securely attached to a saddle 36 which, in turn, is supported by a suspension bracket 38. The suspension bracket 38 is fixedly attached to a frame (not shown) of the clockwork 10.

A torsion pendulum clock is in beat when there is synchronized motion between its pendulum 40 and the ratchet mechanism comprising the escapement wheel 14 and anchor 16. It is important that the suspension fork 28 is perfectly centered over the anchor pin 24 when both pallets are in equal states of engagement/disengagement with the escapement wheel teeth 22 and the torsion pendulum 40 is in its dead position, that is, its static equilibrium position. Thus, when properly adjusted to be in beat, the impulse loads of the anchor pin 24 on the tines 26 will occur when the pendulum is rotated to precisely equal angles away from the dead position of the pendulum. With prior art clocks using a "Graham" type escapement (also referred to as a dead beat escapement) the anchor pin will oscillate approximately 4 degrees left and 4 degrees right during its movement.

The beat of prior art clocks 6 is adjusted by one of two methods. The first method is for suspension springs 32 that are fixedly connected to the suspension bracket 38. With fixed connections, it is necessary to twist the suspension spring 32 until it deforms to align the position of the suspension fork 28 relative to the anchor pin 24.

The second method employs an adjustable saddle wherein the saddle 36 is friction fit onto bracket 38 or the saddle includes a set screw 42 that can be loosened to permit the saddle 36 to rotate freely. Both types of adjustable saddles permit rotational adjustment of the suspension spring 32. All methods require very precise work and some trial and error, even by experienced technicians. One reason prior art designs are difficult to adjust is the multiplier effect wherein minute adjustments to the suspension spring are multiplied into a large movement of the fork's distal end due to it being further outward from the suspension spring's center of rotation.

Figure 2:
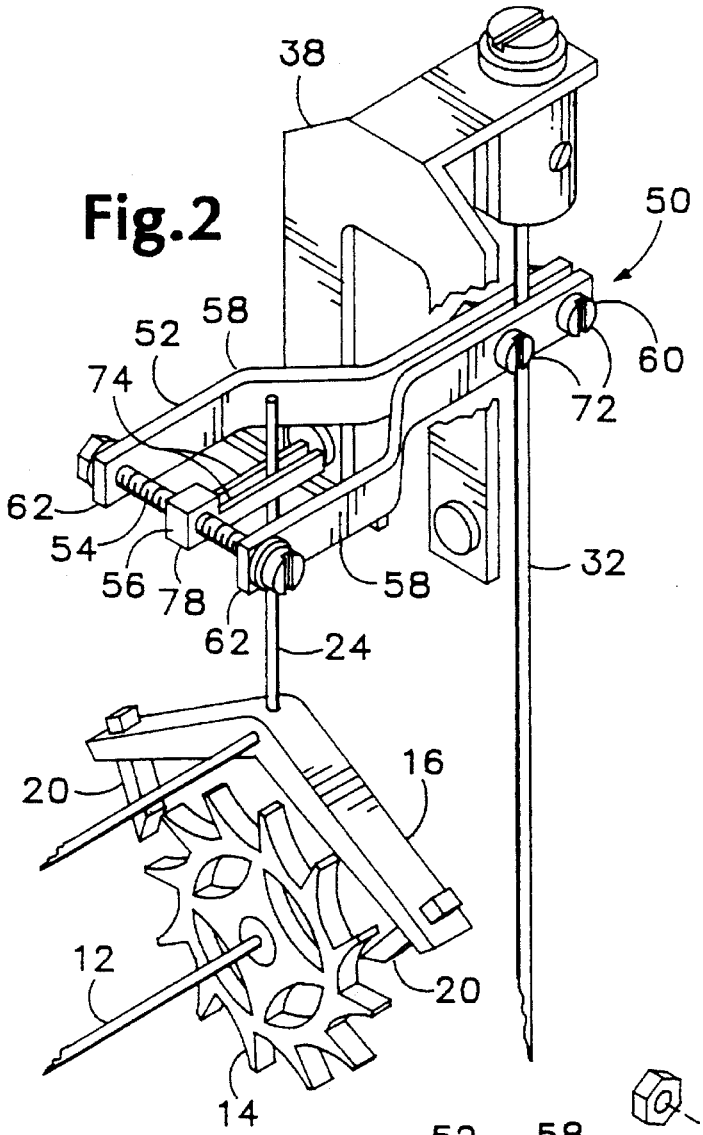
FIG. 2 is a perspective view of a portion of a torsion pendulum clockwork including a preferred embodiment of a suspension fork of the present inventions.
Figure 3:
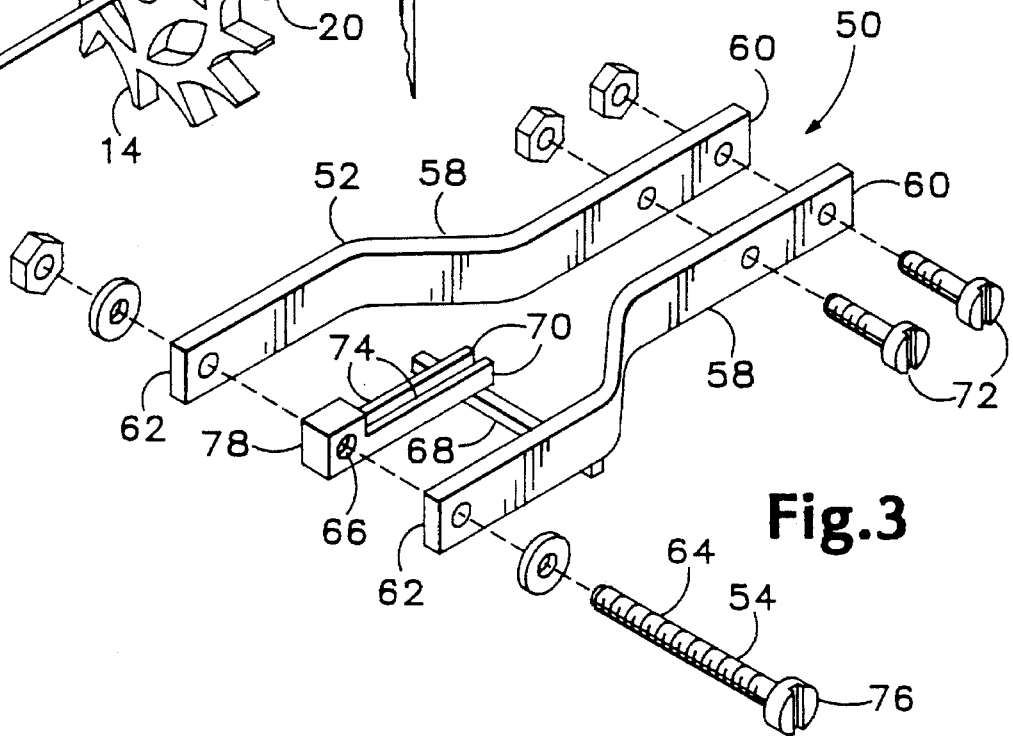
FIG. 3 is an exploded, perspective view of a preferred embodiment of a suspension fork of the present invention.

In FIGS. 2 and 3, there is shown a preferred embodiment of a suspension fork 50 of the present invention. The suspension fork 50 includes a main fork 52, an adjustment mechanism 54, and a tuning fork 56. The main fork includes arms 58 that are connected at a proximal end 60 and are spaced apart at a distal end 62. As configured in the preferred embodiment, shown in FIGS. 2 and 3, the arms bow apart, forming a wishbone shape. The adjustment mechanism 54 is preferably a threaded shaft 64 that is rotatably connected to the distal end 62 of arms 58.

The tuning fork 56 includes a threaded bore 66 that threadingly receives the threaded shaft 64 so that as the shaft is rotated, the tuning fork 56 translates along the length of the threaded shaft 64. Alternative embodiments include an adjustment mechanism 54 having a smooth shaft and a tuning fork 56 having a nylon bushing, or other suitable material, to provide a sliding, friction fit on the smooth shaft. A support bar 68 is further provided to support a distal end 70 of the tuning fork 56 and to prevent rotation of the tuning fork 56 relative to the shaft 64 as the shaft 64 is rotated.

Alternatively, the adjustment mechanism 54 could be threadingly received in the distal ends 62 of arms 58, so that rotation of the adjustment mechanism would cause it to move through the arms 58. The tuning fork 56 would then be rotatably mounted on the adjustment mechanism 54. Rotation of the adjustment mechanism will cause the tuning fork 56 and the adjustment mechanism 54 to move together relative to the main fork 52. Further alternative embodiments are also considered within the scope of the present invention.

Figure 4:
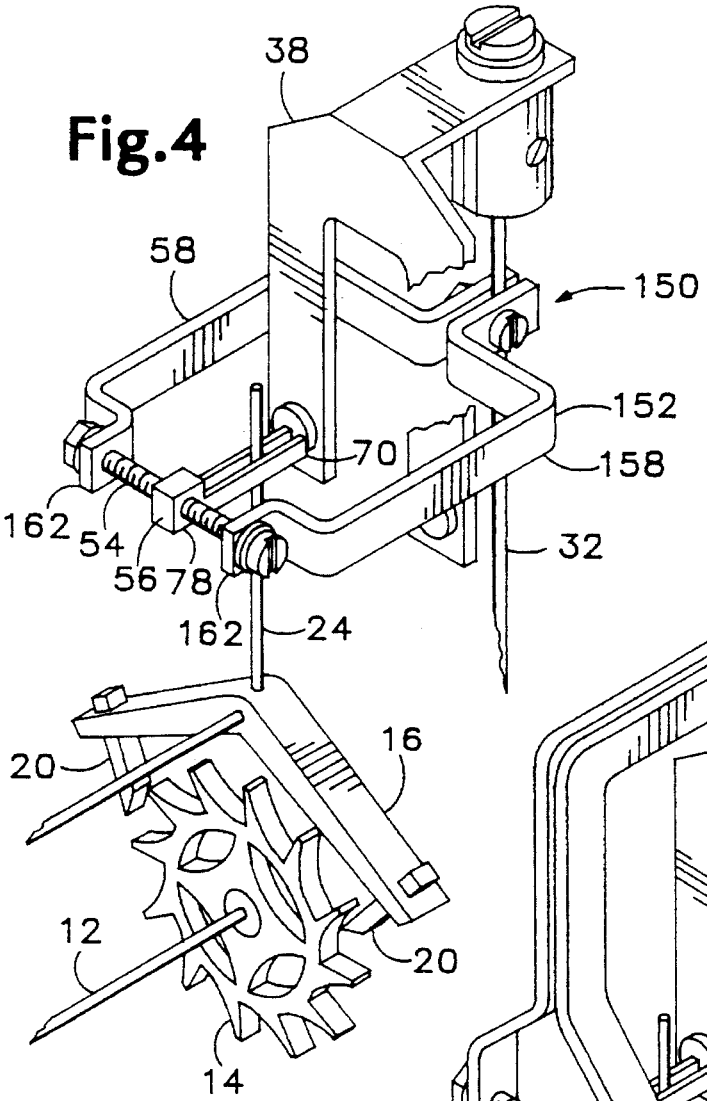
FIG. 4 is a perspective view of a portion of a torsion pendulum clockwork including an alternate preferred embodiment of a suspension fork of the present invention.

FIG. 4 shows an alternative preferred embodiment of a suspension fork 150 of the present invention. As before, the fork 150 comprises a main fork 152 and a tuning fork 56. The main fork of this embodiment includes arms 158 that diverge laterally so as to go around the bracket 38. The adjustment mechanism 54 is then attached to distal ends 162 of the arms 158 and the tuning fork 56 is threadingly inserted on the adjustment mechanism.

Figure 5:
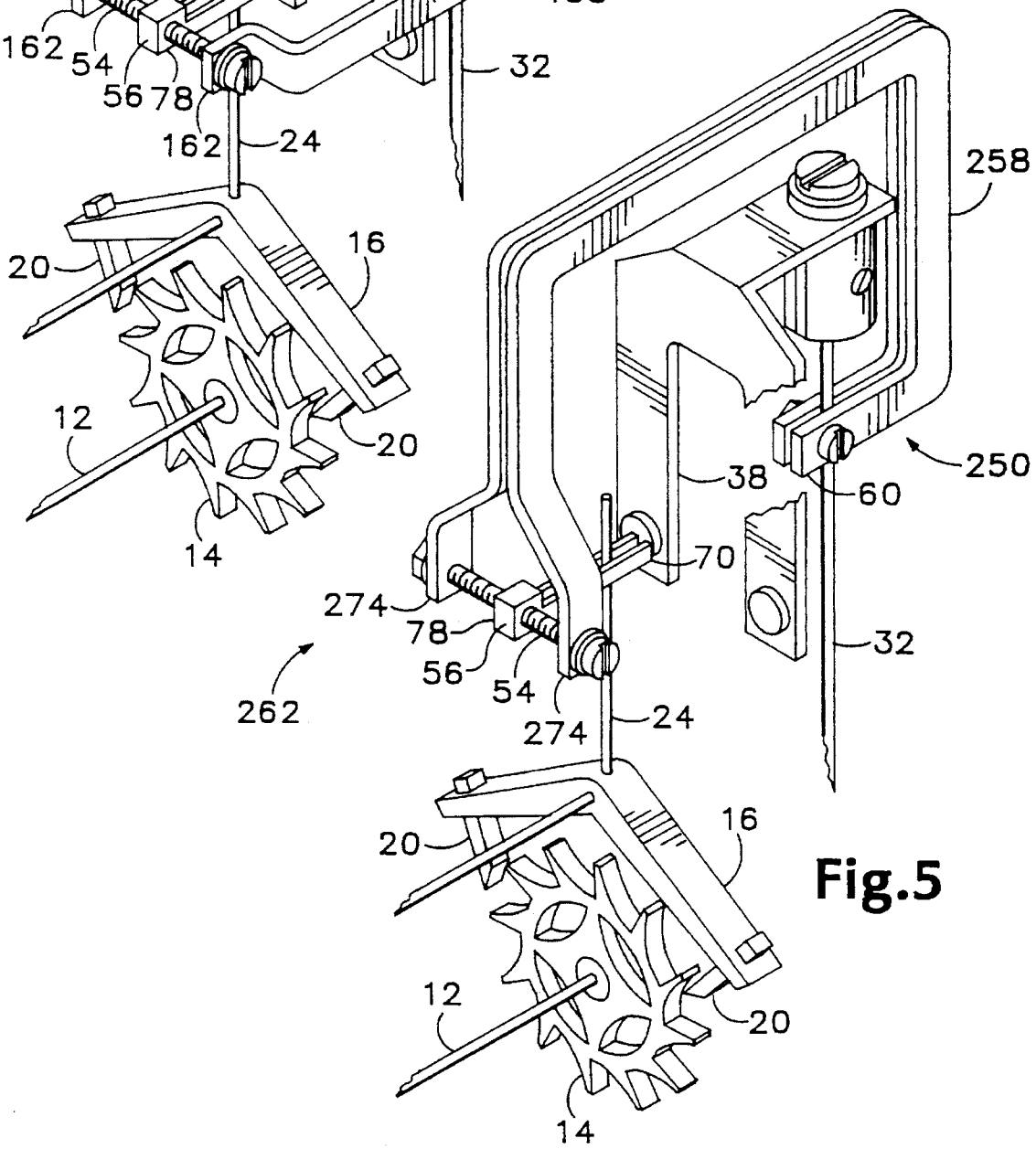
FIG. 5 is a perspective view of portion of a torsion pendulum clockwork including an alternative preferred embodiment of a suspension fork of the present invention.

FIG. 5 shows a further alternative preferred embodiment of a suspension fork 250 of the present invention. In this embodiment, the fork includes an upstanding arm 258 that terminates in a siamese 262. Distal ends 274 of the siamese are spread apart for receiving the adjustment mechanism 54. The tuning fork 56 is threadingly engaged with the adjustment mechanism 54. The embodiments of FIGS. 4 and 5 may also employ support bars, such as bar 68 (FIG. 3).

Once apprised of the teachings and advantages of the present invention a designer could create additional alternative embodiments of a suspension fork incorporating the teachings of the present invention wherein a tuning fork translates relative to a main fork. For example, the tuning fork need not have tines 74 but may capture the anchor pin 24 by other means such as a pin connector that simply attaches to the anchor pin 24. Additionally, although the preferred embodiments show the suspension fork 50 such that the anchor pin 24 is between the adjustment mechanism 54 and the suspension spring 32, it is within the scope of this invention to arrange the fork 50 so that the adjustment mechanism is between the anchor pin and suspension spring.

A suspension fork 50 of the present invention is shown in FIG. 2 connected to a prior art clockwork 10, replacing the prior art suspension fork 28. The proximal end 60 of the main fork 50 is fixedly attached to the suspension spring 32, such as by bolts 72, or other suitable fastening means. The arms 58 extend through the suspension bracket 38 and surround the anchor pin 24. The tuning fork 56 is positioned approximately midway between the distal ends 62 of the arms 58 and arranged so that its tines 74 are positioned symmetrically about the anchor pin 24.

The beat of the clock can now be adjusted easily and precisely by operation of the adjustment mechanism 54. In its preferred embodiment using threaded shaft 64, the adjustment mechanism is operated by rotating a head 76 of the shaft. Because the tuning fork 56 is threaded onto the threaded shaft 64, it will process, that is translate, along the length of the threaded shaft as the shaft is being turned. Because the threaded shaft 64 is rotatably attached to the arms 58, it will merely rotate without translation relative to those arms. Thus, the tuning fork 56 will be adjusted relative to the main fork 52.

The adjustment mechanism 54 may include a locking device (not shown) for fixing the position of the adjustment mechanism relative to the main fork 52.

The adjustment mechanism may further include calibrated index markings to provide a visual indication of a movement of the adjustment mechanism during the adjustment process. In the preferred embodiment, the index markings may be provided on the head 76 of a threaded shaft 64 and companion markings on the distal end 62 of one arm 58.

The present structure further improves the precision of beat adjustment by virtue of having a linear adjustment mechanism. The linear adjustment means that the tuning fork's distal end 70 moves equally with its proximal end 78 when the proximal end is adjusted. Thus, greater adjustment precision can be achieved because adjustment of the proximal end 78 will not be multiplied at the distal end 70 as occurred with prior art forks 28 (FIG. 1).

The present invention also increases the power transmission from the escapement to the torsion pendulum 40. It is theorized that the improved power efficiency is due to the additional leverage created by the length of the main spring arms 58. It is believed that the present embodiment requires less pressure from the escape wheel against the pallets to raise the pallets which, in turn, move the anchor 16 and anchor pin 24.

Early embodiments of the suspension fork 50 of the present invention have been constructed using light-weight metals, such as aluminum. Prototypes have also been constructed using brass for the arms 58 and tuning fork 56, and threaded bolts for the threaded shaft 64 with favorable results. The additional weight of the suspension fork 50 of the present invention over that of prior art suspension forks 28 does not affect clock performance.

Numerous characteristics and advantages of the invention have been set forth in the foregoing description, together with details of the structure and function of the invention. The novel features hereof are pointed out in the appended claims. The disclosure is illustrative only, and changes may be made in detail, especially in matters of shape, size, and arrangement of parts within the principle of the invention to the full extent indicated by the broad general meaning of the terms in the claims.

I claim:

1. A suspension fork for a torsion pendulum clock, comprising:

(a) a first fork; and (b) a tuning fork for coupling to an anchor pin of a torsion pendulum clock, the tuning fork adjustably connected to the first fork for translation relative thereto.

2. The suspension fork of claim 1 wherein the first fork is configured as a wishbone.

3. The suspension fork of claim 1 wherein the first fork is configured as a wishbone having proximal and distal ends and the second fork is adjustably connected to the distal ends of the first fork.

4. The suspension fork of claim 1 wherein the tuning fork is adjustably connected to the first fork by a threaded shaft and wherein rotation of the shaft causes the tuning fork to translate relative to the first fork.

5. The suspension fork of claim 1 wherein the first fork includes at least two arms connected at a proximal end and spaced-apart at a distal end.

6. The suspension fork of claim 1 wherein the first fork is an arm having a siamese distal end.

7. The suspension fork of claim 1 wherein the tuning fork is configured as a tuning fork.

8. A suspension fork for a torsion pendulum clock, comprising:

(a) a first fork including a proximal end and a distal end;

(b) a tuning fork for coupling to an anchor pin of a torsion pendulum clock; and (c) an adjustment mechanism, interconnectedly attached to the first fork and the tuning fork, wherein operation of the adjustment mechanism causes movement of the tuning fork relative to the first fork.

9. The suspension fork of claim 8 wherein the first fork is configured in a wishbone shape.

10. The suspension fork of claim 8 wherein the tuning fork is configured in a tuning fork shape.

11. The suspension fork of claim 8 wherein the first fork is configured as an arm having a siamese distal end.

12. The suspension fork of claim 8 wherein the adjustment mechanism comprises a threaded shaft.

13. The suspension fork of claim 8 wherein the tuning fork further comprises a threaded bore that receives the adjustment mechanism.

14. A clock, comprising:

(a) a pendulum suspended by a suspension spring;

(b) a suspension fork connected to the suspension spring for movement therewith and having a tuning fork adjustably attached to a first fork;

(c) a ratchet mechanism including an anchor pin that is arranged for interaction with the tuning fork;

(d) whereby movement of the ratchet mechanism is communicated to the suspension fork and the suspension spring.

15. The clock of claim 14 wherein the suspension fork includes an adjustment mechanism interconnectingly attached to the first fork and the tuning fork.

16. The clock of claim 14 wherein the tuning fork includes tines arranged on opposite sides of the anchor pin.

17. The clock of claim 13 wherein the suspension spring defines an axis of rotation of the suspension fork and the suspension fork includes an adjustment mechanism interconnectingly attached to the first fork and tuning fork wherein the adjustment mechanism is arranged radially beyond the anchor pin relative to the axis of rotation.

18. A method of adjusting the beat of a torsion pendulum clock having a pendulum suspended by a suspension spring, comprising the steps:

(a) attaching a suspension fork to the suspension spring, the suspension fork having an adjustment mechanism interconnectingly attached to an arm of the suspension fork and a pin connector;

(b) locating the pin connector about an anchor pin; and (c) adjusting the suspension fork by operating the adjustment mechanism to move the pin connector relative to the arm thereby adjusting the beat of the clock.

19. The method of claim 18 wherein the adjustment mechanism is a threaded member and the adjusting step comprises rotating the threaded member to cause the pin connector to move relative to the arm.

* * * * *